US010391558B2

(12) United States Patent
Ha et al.

(10) Patent No.: US 10,391,558 B2
(45) Date of Patent: Aug. 27, 2019

(54) POWDER MANUFACTURING APPARATUS AND POWDER FORMING METHOD

(71) Applicant: POSCO, Pohang-si, Gyeongsangbuk-do (KR)

(72) Inventors: Tae-Jong Ha, Pohang-si (KR); Si-Won Yoon, Pohang-si (KR); Hae-Kwon Jeong, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 377 days.

(21) Appl. No.: 15/035,110

(22) PCT Filed: Dec. 24, 2013

(86) PCT No.: PCT/KR2013/012073
§ 371 (c)(1),
(2) Date: May 6, 2016

(87) PCT Pub. No.: WO2015/093672
PCT Pub. Date: Jun. 25, 2015

(65) Prior Publication Data

US 2016/0279712 A1 Sep. 29, 2016

(30) Foreign Application Priority Data

Dec. 20, 2013 (KR) ..... 10-2013-0160260

(51) Int. Cl.
*B22F 9/08* (2006.01)
*B22F 1/00* (2006.01)

(52) U.S. Cl.
CPC ..... *B22F 9/082* (2013.01); *B22F 1/0003* (2013.01); *B22F 2009/088* (2013.01);
(Continued)

(58) Field of Classification Search
None
See application file for complete search history.

(56) References Cited

U.S. PATENT DOCUMENTS 3,340,334 A 9/1967 Feldmann et al.
3,639,548 A 2/1972 Ullman et al.
(Continued)

FOREIGN PATENT DOCUMENTS

CN 1986119 A 6/2007
CN 203817397 U 9/2014
(Continued)

OTHER PUBLICATIONS

International Search Report issued in International Application No. PCT/KR2013/012073, dated Sep. 22, 2014, with English Translation.

(Continued)

*Primary Examiner* — George Wyszomierski
(74) *Attorney, Agent, or Firm* — Morgan, Lewis & Bockius LLP

(57) ABSTRACT

The present invention provides a power manufacturing apparatus capable of preventing particle growth when fine powder is formed through a fluid, the apparatus comprising: a molten steel providing part for providing molten steel; and a cooling fluid spraying part which is arranged at a lower part of the molten steel providing part and sprays a cooling fluid on the molten steel in order to pulverize the molten steel provided by the molten steel providing part, wherein the cooling fluid spraying part forms a first flow for cooling the molten steel so as to pulverize the molten steel and a second flow for forming a descending air current in the molten steel.

6 Claims, 13 Drawing Sheets

(52) U.S. Cl.
CPC ..... *B22F 2009/0828* (2013.01); *B22F 2009/0832* (2013.01); *B22F 2009/0848* (2013.01); *B22F 2009/0872* (2013.01); *B22F 2009/0884* (2013.01); *B22F 2009/0892* (2013.01); *B22F 2301/35* (2013.01)

(56) References Cited

U.S. PATENT DOCUMENTS

| | | | | |
|---|---|---|---|---|
| 3,814,558 | A * | 6/1974 | Ayers | B22F 9/082 264/11 |
| 4,416,600 | A | 11/1983 | Lecznar et al. | |
| 4,897,111 | A * | 1/1990 | Jonsson | B01J 2/04 425/7 |
| 4,988,464 | A | 1/1991 | Riley | |
| 6,254,661 | B1 * | 7/2001 | Takeda | B22F 9/082 75/337 |
| 8,012,408 | B2 | 9/2011 | Watanabe | |
| 2004/0031354 | A1 | 2/2004 | Tornberg | |
| 2007/0246131 | A1 | 10/2007 | Watanabe | |
| 2010/0219268 | A1 | 9/2010 | Wurz | |

FOREIGN PATENT DOCUMENTS

| | | | |
|---|---|---|---|
| EP | 1063038 | A1 | 12/2000 |
| EP | 1800760 | A1 | 6/2007 |
| EP | 1800760 | A1 * | 6/2007 |
| JP | S53-89866 | A | 8/1978 |
| JP | 58-81903 | A | 5/1983 |
| JP | 58-157904 | A | 9/1983 |
| JP | S63-50404 | A | 3/1988 |
| JP | 1-123012 | A | 5/1989 |
| JP | 3-32735 | A | 2/1991 |
| JP | H4-168207 | A | 6/1992 |
| JP | 6-256966 | A | 9/1994 |
| JP | 7-246452 | A | 9/1995 |
| JP | 2000-104103 | A | 4/2000 |
| JP | 2001-226704 | A | 8/2001 |
| JP | 2007-291454 | A | 11/2007 |
| KR | 10-2004-0067608 | A | 7/2004 |
| KR | 10-2013-0063856 | A | 6/2013 |

OTHER PUBLICATIONS

Extended European Search Report dated Dec. 5, 2016 issued in European Patent Application No. 13899454.6.
Chinese Office Action dated Dec. 30, 2016 issued in Chinese Patent Application No. 201380081785.3 (English translation).
Office Action issued in corresponding Japanese Patent Application No. 2006-541022, dated Aug. 29, 2017.
Office Action issued in corresponding European Patent Application No. 13899454.6, dated Oct. 5, 2017.

* cited by examiner

POWDER MANUFACTURING APPARATUS AND POWDER FORMING METHOD

RELATED APPLICATIONS

This application is U.S. National Phase under 35 U.S.C. § 371 of International Application No. PCT/KR2013/012073, filed on Dec. 24, 2013,which in turn claims the benefit of Korean Application No. 10-2013-0160260, filed on Dec. 20, 2013, the disclosures of which Application are incorporated by reference herein.

TECHNICAL FIELD

The present disclosure relates to a powder manufacturing apparatus and a powder forming method for producing powder from molten steel, and more particularly, to a powder manufacturing apparatus and a powder forming method for atomizing molten steel into uniform powder by ejecting a cooling fluid onto the molten steel.

BACKGROUND ART

The shapes of automobiles and metal components have become complex, and demand thereof has increased. Thus, besides traditional manufacturing methods such as forging and casting methods, methods optimized for mass production such as hot press forming (HPF) have been increasingly used. Owing to the development of HPF technology, the rigidity and other properties of products formed of metal powder have improved, and thus the use of HPF for manufacturing complex automobile components has been gradually increased. Therefore, atomization techniques for producing metal powder in large quantities have been researched. FIG. 1 illustrates a powder manufacturing apparatus for producing fine powder (P) by atomizing molten steel (S) using a fluid such as high-pressure gas or cooling water. The powder manufacturing apparatus may be used to produce micro-size fine powder having an intended particle size distribution and properties. Molten steel (S) flowing downward from a molten steel supply unit 10 is atomized into fine powder (P) by a fluid ejected onto the molten steel (S) from jet nozzles 30 mounted on a main body 20. The jet nozzles 30 are connected to a fixed body 11, and ejection positions of the jet nozzles 30 connected to the fixed body 11 are adjustable to vary a striking point at which a fluid ejected from the jet nozzles 30 strike molten steel (S).

A method of using inert gas as a fluid has merits such as the formation of very fine powder, uniformity in particle size, and nonoccurrence of powder oxidation, but has demerits in terms of mass production. On the other hand, although a water jet method using cooling water has demerits such as uneven particle surface shapes, difficulty in obtaining uniform particles, and a high possibility of metal powder oxidation, the water jet method has merits in terms of mass production. Since there is markedly increasing demand for metal powder as a raw material for manufacturing automobile components, the water jet method using cooling water is considered a competitive method for producing metal powder.

When metal powder is produced by the water jet method, the metal powder quality is determined by factors such as particle size distribution, apparent density, surface shape, and oxygen content of the metal powder. The particle size distribution, apparent density, and surface shape of metal powder are mostly determined in a water jet process, and variables of the water jet process such as the amount and pressure of cooling water, the initial temperature of molten steel, and the structures of nozzles have an effect on the properties of metal powder. In a general water jet process, molten steel is atomized into fine metal powder and cooled as high-pressure cooling water strikes the molten steel, and the atomization degree and the surface shape of the metal powder are determined by the pressure of the cooling water, specifically, the size and velocity of cooling water droplets and the magnitude of impulse applied by the cooling water droplets. Water jet nozzles and nozzle structures for forming water droplets and effectively atomizing molten steel by striking the molten steel with the water droplets have been developed and commercialized.

In the related art, such nozzle structures are generally classified into two types.

First, as illustrated in FIG. 2, a V-jet type nozzle structure is used. In the V-jet type nozzle structure, nozzle tips 31 are configured to eject fan-shaped streams of cooling water toward a point of a stream of molten steel so as to produce metal powder. The V-jet type nozzle structure includes a plurality of nozzle tips 31, and cooling water ejected through the nozzle tips 31 spreads widely. Thus, it is easy to set process conditions and adjust the angle at which cooling water strikes molten steel. However, the number of cooling water droplets effectively striking molten steel is relatively small, and thus a large amount of cooling water is used to produce powder.

As illustrated in FIG. 3, the other is a ring type nozzle structure including a ring-shaped one-piece nozzle 35 and ejection holes 36 through which streams of cooling water are ejected toward a point of molten steel. Compared to the V-jet type nozzle structure, a relatively great impulse is applied to molten steel by cooling water droplets (fluid droplets), and thus a less amount of fluid is used. However, if initial process conditions are not perfect, it is difficult to adjust the angle of fluid droplets with respect to a point of molten steel. In addition, it is difficult to manufacture the ring type nozzle structure in one-piece for high-pressure fluid ejection.

Moreover, in both the nozzle structures, if the striking angle at which a fluid strikes molten steel is varied, fine powder formed from the molten steel may not fall but may form large lumps depending on the flow of cooling water and air.

(Patent Document 1) KR10-2004-0067608 A

DISCLOSURE

Technical Problem

To solve the above-described problems of the related art, an aspect of the present disclosure may provide a powder manufacturing apparatus and a powder forming method for forming fine powder using a fluid while preventing the powder from becoming coarse.

An aspect of the present disclosure may also provide a powder manufacturing apparatus and a powder forming method allowing for stable processing even though process conditions vary.

As aspect of the present disclosure may also provide a powder manufacturing apparatus and a powder forming method for producing powder having a predetermined particle size distribution and an average particle size while increasing the amount of cooling water, increasing the magnitude of impulse, and guaranteeing a predetermined striking angle.

Technical Solution

The present disclosure provides a powder manufacturing apparatus and a powder forming method as described below so as to accomplish the above-mentioned aspects of the present disclosure.

According to an aspect of the present disclosure, a powder manufacturing apparatus may include: a molten steel supply unit supplying molten steel; and a cooling fluid ejection unit disposed below the molten steel supply unit and ejecting a cooling fluid to the molten steel supplied from the molten steel supply unit so as to atomize the molten steel, wherein the cooling fluid ejection unit may form a first stream to cool and atomize the molten steel and a second stream to create a descending air current for the molten steel.

The cooling fluid ejection unit may include: a guide including a truncated cone part pointed downward so that the molten steel flowing downward from the molten steel supply unit may pass through a center region of the truncated cone part; and a jet nozzle ejecting the cooling fluid onto the guide.

The second stream may swirl downward around the molten steel flowing downward.

A spiral may be formed on the guide to induce the second stream. The spiral may be a groove formed in a surface of the guide.

A plurality of spirals may be symmetrically formed on the guide.

The cooling fluid ejection unit may be configured so that the first stream may flow at a rate greater than a rate at which the second stream flows.

The jet nozzle may be a straight jet nozzle pointed so that the cooling fluid may be ejected toward the truncated cone part of the guide.

The jet nozzle may be located above the truncated cone part of the guide, and an angle between the jet nozzle and a vertical line may be greater than an angle between a slope of the truncated cone part and the vertical line.

The spiral may induce the descending air current at a point at which extension lines drawn from the slope of the truncated cone part intersect each other.

The cooling fluid may be water.

According to another aspect of the present disclosure, a powder forming method may include: supplying molten steel; forming powder by atomizing the molten steel using a cooling fluid; and, during the forming of the powder, creating a descending air current using the cooling fluid at a point at which the cooling fluid strikes the molten steel so as to prevent the powder from becoming coarse.

In the forming of the powder, a cooling fluid barrier may be formed around the point at which the cooling fluid strikes molten steel, so as to prevent introduction of external gas.

The creating of the descending air current may include swirling the cooling fluid downward so as to create the descending air current by a swirling stream of the cooling fluid.

Advantageous Effects

Owing to the above-described configurations of the powder manufacturing apparatus and the powder forming method, when fine powder is formed using a fluid, the fine powder may be prevented from becoming coarse.

In addition, according to the powder manufacturing apparatus and the powder forming method processes may be stably performed even though process conditions vary.

In addition, the powder manufacturing apparatus and the powder forming method may be used to produce powder having a predetermined particle size distribution and an average particle size while decreasing the amount of cooling water, increasing the magnitude of impulse, and guaranteeing a predetermined striking angle.

BEST MODE

Hereinafter, exemplary embodiments of the present disclosure will be described in detail with reference to the accompanying drawings.

Figure 4:
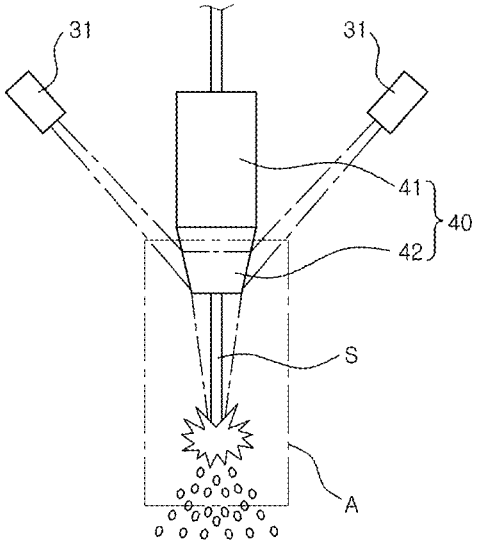
FIG. 4 is a view illustrating a powder manufacturing apparatus including a guide.
Figure 5:
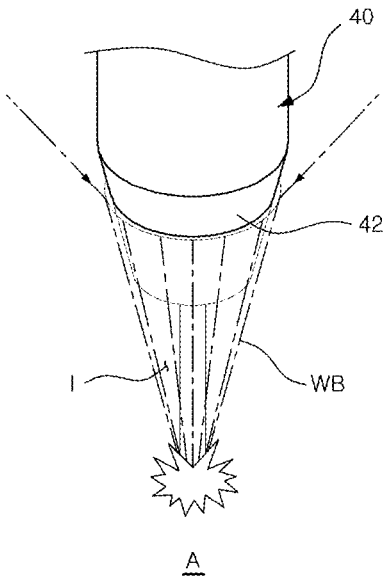
FIG. 5 is an enlarged view illustrating the guide illustrated in FIG. 4.

A technique of using a guide has been proposed as illustrated in FIGS. 4 and 5 to improve the two types of nozzle structures described in the background art. That is, in the proposed structure, straight jet nozzles 31 are used, and a guide 40 shaped like a reverse truncated cone is disposed to guide and concentrate cooling water at a molten steel striking point. The jet nozzles 31 eject cooling water onto the guide 40 to concentrate the cooling water at the molten steel striking point.

Figure 6:
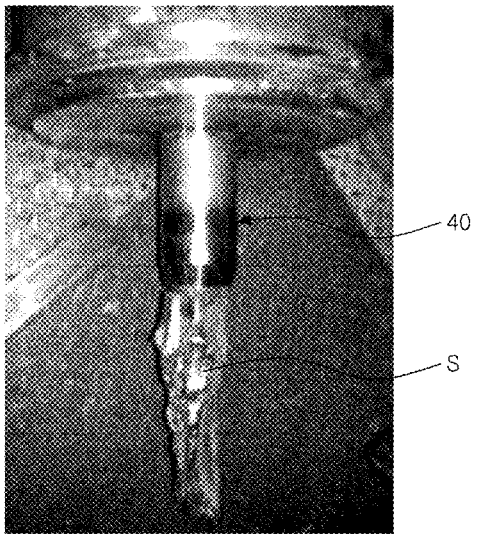
FIG. 6 is an image of the powder manufacturing apparatus illustrated in FIGS. 4 and 5, taken when the powder manufacturing apparatus is clogged with molten steel.

In the proposed structure, a cone-shape cooling water barrier WB is formed by cooling water ejected onto the guide 40, and since the cooling water barrier WB blocks the introduction of ambient air, an inside region I of the cooling water barrier WB is isolated. Therefore, if the cooling water does not smoothly strike molten steel at the molten steel striking point, the molten steel may solidify in the inside region I of the cooling water barrier WB as illustrated in FIG. 6.

In the structure illustrated in FIG. 5, if cooling water is normally ejected, the sizes of most particles of produced powder are around the average particle size of the powder. However, in case of nozzle angle variations, a decrease in the magnitude of impulse, a change in the amount of cooling water, or a decrease in mass flow, the particle size distribution of powder may be widened, and thus the fraction of oversized powder may increase. Since such oversized iron powder is discarded as scrap, the yield of powder production may decrease. Therefore, in a water jet process, it is required that smooth flow of iron powder and the magnitude of impulse be maintained at a certain value or greater, so as to efficiently produce iron powder.

Figure 7:
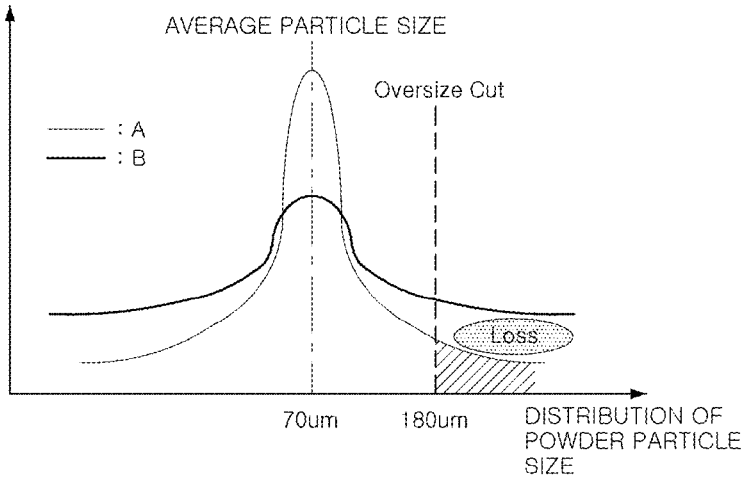
FIG. 7 is a graph illustrating a relationship between the particle size distribution and average particle size of powder.

That is, as illustrated in FIG. 7, although the same average particle size is obtained in both normal and abnormal situations, the distribution of particle size is relatively wide in the abnormal situation, and thus the fraction of oversized powder particles increases. As a result, the amount of powder discarded as scrap increases, and the yield of powder production decreases.

Particularly, although a cooling water barrier WB formed by the guide 40 is effective in concentrating cooling water, the cooling water barrier WB blocks ambient air and forms negative pressure in a region above a molten steel striking point. Thus, if cooling water does not smoothly strike molten steel, the molten steel may unexpectedly solidify, or the particle size of iron powder may markedly deviate.

Thus, as a technique for removing the demerits of the guide 40 (such as the formation of negative pressure in a cooling water barrier) while maintaining the merits of the guide 40 (such as ease in concentrating cooling water at a molten steel striking point, and stable production of powder even under varying process conditions), the inventors have proposed a guide structure configured to create a first stream for cooling and atomizing molten steel and a second stream for inducing a descending air current facilitating the discharge of powder when the molten steel is atomized by collision with cooling water.

Figure 8:
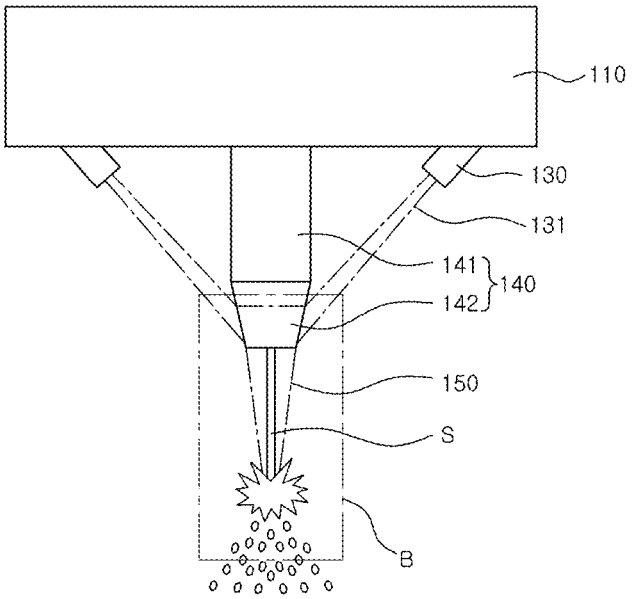
FIG. 8 is a schematic view illustrating a powder manufacturing apparatus according to an embodiment of the present disclosure.
Figure 9:
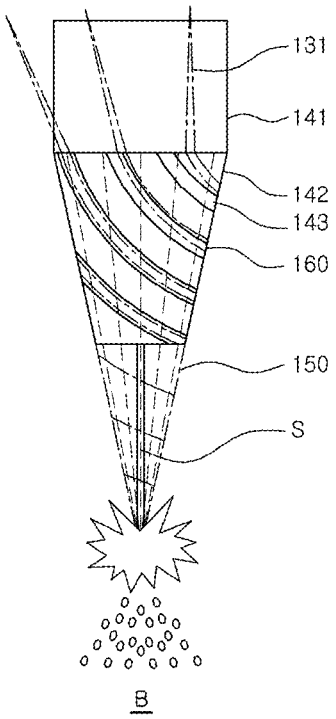
FIG. 9 is an enlarged view illustrating a guide illustrated in FIG. 8.
Figure 10:
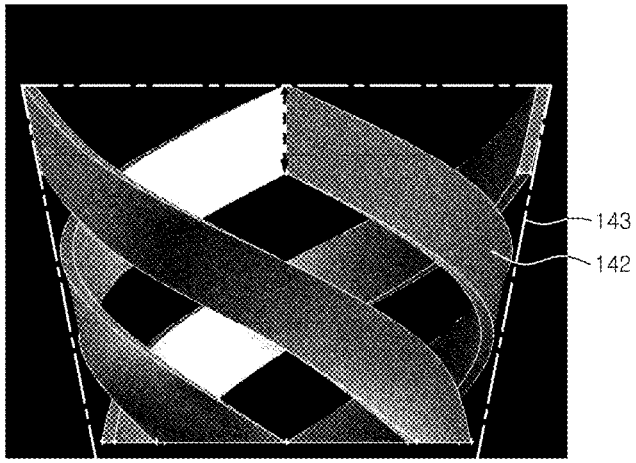
FIG. 10 is a detailed view illustrating spirals illustrated in FIG. 9.

FIG. 8 is a schematic view illustrating a powder manufacturing apparatus according to an exemplary embodiment of the present disclosure. FIG. 9 is a detailed view illustrating a guide 140 illustrated in FIG. 8, and FIG. 10 is a detailed view illustrating spirals 143 illustrated in FIG. 9.

Figure 1:
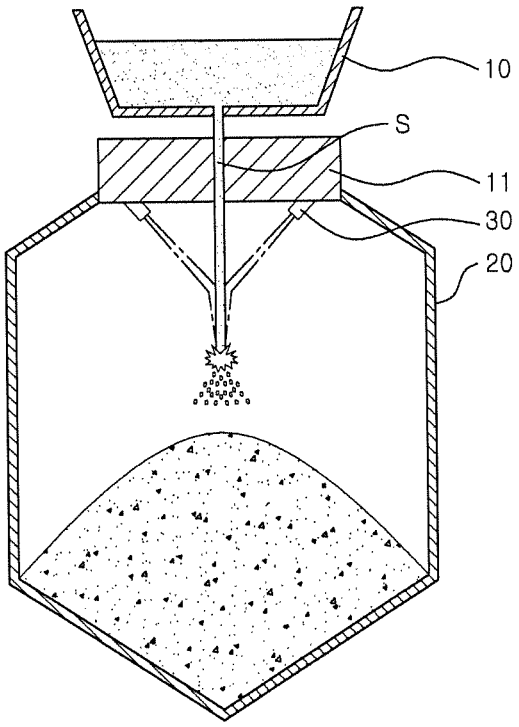
PRIOR ART FIG. 1
FIG. 1 is a schematic view illustrating a powder manufacturing apparatus of the related art.

As illustrated in FIG. 8, the powder manufacturing apparatus of the embodiment may have the same structure as the powder manufacturing apparatus illustrated in FIG. 1 except for a cooling fluid ejection unit, and thus the cooling fluid ejection unit will now be mainly described.

The cooling fluid ejection unit includes: the guide 140 including a truncated cone part 142 oriented downward so that molten steel flowing downward from a molten steel supply unit 10 (refer to FIG. 1) may pass through a center region of the truncated cone part 142; and jet nozzles 130 disposed around the guide 140 to eject a cooling fluid toward the guide 140. The jet nozzles 130 are connected to a fixed body 110 and oriented to eject a cooling fluid toward the guide 140.

The jet nozzles 130 may be pointed toward a region located just below a boundary between the truncated cone part 142 and a cylindrical part 141 of the guide 140. However, the jet nozzles 130 are not limited thereto. For example, even if the jet nozzles 130 are pointed toward any point of the truncated cone part 142, a cooling fluid ejected through the jet nozzles 130 may be concentrated by the guide 140. In the embodiment illustrated in FIG. 8, cooling water is ejected as a cooling fluid through the jet nozzles 130. However, a cooling fluid that may be ejected through the jet nozzles 130 is not limited to cooling water. For example, inert gas or air may be used as a cooling fluid according to the type of molten steel.

The jet nozzles 130 may be straight jet nozzles configured to eject a cooling fluid toward a single point. However, as long as a cooling fluid ejected from the jet nozzles 130 strikes the guide 140 and forms first streams 150 and second streams 160, the jet nozzles 130 are not limited to the straight jet type. For example, the jet nozzles 130 may be V-jet or ring type nozzles.

The guide 140 includes: the cylindrical part 141 connected to the fixed body 110; and the truncated cone part 142 extending from the cylindrical part 141 and having a reverse truncated cone shape. As illustrated in FIGS. 9 and 10, the spirals 143 are formed on the truncated cone part 142 to generate first streams 150 for atomizing molten steel and second streams 160 for forming a descending air current.

As illustrated in FIG. 9, according to the embodiment of the present disclosure, cooling water 131 striking the truncated cone part 142 of the guide 140 forms first streams 150, and the first streams 150 flow downward along the surface of the truncated cone part 142 and strike molten steel. The first streams 150 are formed from ejection positions along the guide 140, and as a result, a cooling water barrier WB is formed by the first streams 150.

In the embodiment of the present disclosure, since the spirals 143 are formed on the truncated cone part 142, a portion of cooling water 131 ejected onto the guide 140 forms second streams 160 swirling along the spirals 143 toward a molten steel striking point. Since the second streams 160 are spiral streams narrowing in a downward direction, the second streams 160 form a descending air current while passing by the molten steel striking point. That is, a downward flow is formed in a region around the molten steel striking point, and thus molten steel atomized into powder by the cooling water 131 is easily discharged downward by the downward flow.

The spirals 143 may be symmetrically formed in the same shape around the truncated cone part 142.

In the embodiment of the present disclosure, if the rate of the second stream 160 is increased to apply a great impulse to molten steel, atomization of the molten steel may be negatively affected. Therefore, when the cooling water 131 ejected through the jet nozzles 130 is divided by the guide 140 into the first and second streams 150 and 160, the rate of the first streams 150 may be greater than the rate of the second streams 160. This flow rate distribution may be accomplished by adjusting the height or depth of the spirals 143 and the number of the spirals 143.

In addition, as illustrated in FIG. 9, ejection positions onto which the cooling water 131 is ejected from the jet nozzles 130 may be on the spirals 143. However, the ejection positions may not be on the spirals 143. Even in this case, since the first streams 150 meet the spirals 143, the second streams 160 may be naturally formed. That is, the ejection positions have no effect on the formation of the first and second streams 150 and 160.

The powder manufacturing apparatus of the embodiment of the present disclosure is configured to supply molten steel from the molten steel supply unit 10 and atomize the molten steel into powder by striking the molten steel with a cooling fluid. At this time, while atomizing the molten steel into powder, a descending air current is formed by the cooling fluid so as to prevent the formation of coarse powder, that is, to prevent variations in the particle size of the powder. According to a powder forming method of an embodiment of the present disclosure, first streams and second streams are formed by a cooling fluid. The first streams strike molten steel, and the second streams swirl downward along spiral paths around the molten steel, and thus form a descending air current. Therefore, powder formed in a region in which the first streams strikes the molten steel may be pulled downward by the descending air current.

In terms of manufacturing methods, second streams may be formed using any other method or structure instead of using a guide as long as the second streams form a descending air current at a position at which first streams strike molten steel. However, if a guide is used, the first and second streams may be simultaneously formed.

Figure 11:
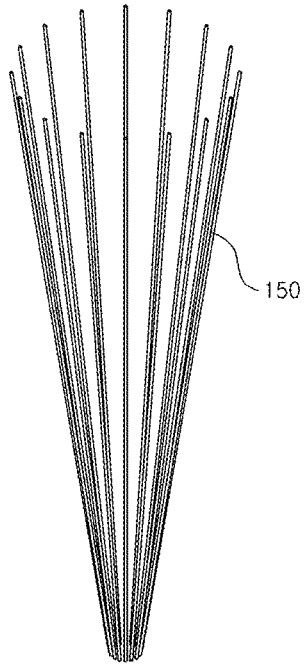
FIG. 11 is a schematic view illustrating first streams illustrated in FIG. 8.
Figure 12:
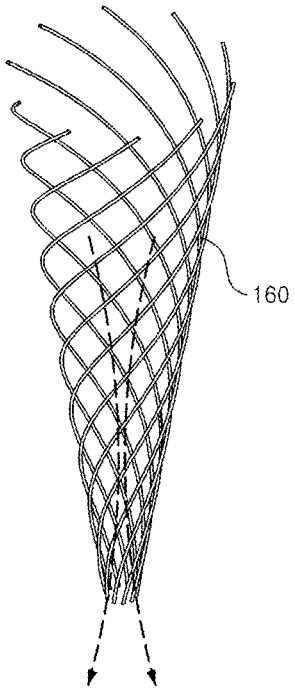
FIG. 12 is a schematic view illustrating second streams illustrated in FIG. 8.
Figure 13:
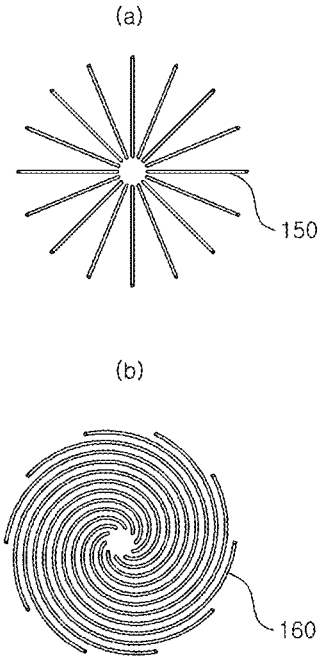
FIGS. 13A and 13B are schematic plan views illustrating the first and second streams illustrated in FIGS. 11 and 12.

FIG. 11 is a schematic view illustrating the first streams 150 illustrated in FIG. 8, and FIG. 12 is a schematic view illustrating the second streams 160 illustrated in FIG. 8. FIGS. 13A and 13B are a schematic plan view illustrating the first and second streams 150 and 160 illustrated in FIGS. 11 and 12.

Figure 3:
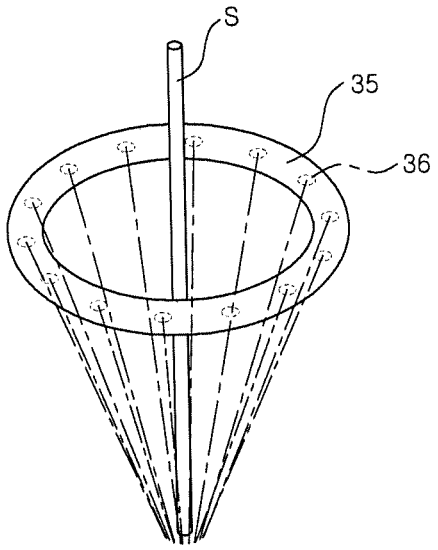
PRIOR ART FIG. 3
FIG. 3 is a schematic view illustrating a powder manufacturing apparatus including a ring type jet nozzle according to the related art.

As illustrated in FIGS. 11 and 13A, the first streams 150 concentrate at a single point, and thus a great impulse may be applied to molten steel. In addition, since the first streams 150 are formed along a slope of the guide 140, the positions of the jet nozzles 130 may be flexibly set compared to the structure illustrated FIG. 3. In particular, in the related art illustrated in FIG. 3, if a molten steel striking point is varied because of change in process conditions or molten steel, the cooling fluid ejection unit may be replaced. According to the embodiment of the present disclosure, however, a molten steel striking point may be adjusted by only varying the height of the guide 140, and a great impulse may be applied at the molten steel striking point.

As illustrated in FIGS. 12 and 13B, the second streams 160 being spiral streams concentrate in a direction toward the molten steel striking point, thereby creating a descending air current. These spiral streams do not collide with each other at a single point but converge and diverge, thereby forming a descending air current inside the spiral streams in the proceeding direction of the spiral streams. According to the embodiment of the present disclosure, upward motion of molten steel may not be induced at the molten steel striking point by a cooling water barrier WB formed by the first streams 150 owing to the descending air current formed by second streams 160, and the molten steel atomized into powder by collision with a cooling fluid may be smoothly discharged downward owing to the descending air current.

Specifically, since powder (metal powder) is discharged by the descending air current, events varying the particle size of the powder such as agglomeration of the powder may not occur, thereby preventing variations in the particle size of the powder and guaranteeing the uniformity of the powder. Thus, loss may be reduced, and the yield of powder production may be increased.

Figure 2:
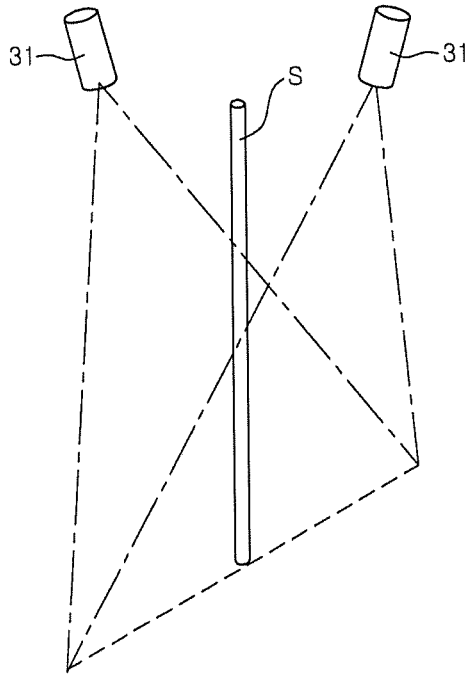
PRIOR ART FIG. 2
FIG. 2 is a schematic view illustrating a powder manufacturing apparatus including V-jet type jet nozzles according to the related art.
Figure 14:
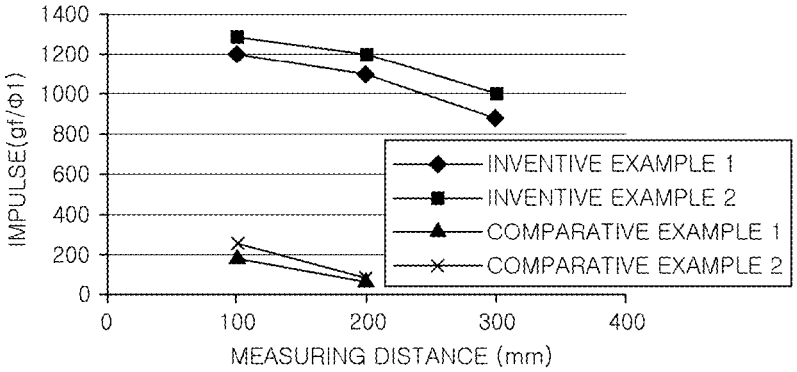
FIG. 14 is a graph of the magnitude of impulse in inventive examples and comparative examples.

FIG. 14 is a graph illustrating impulse in inventive examples and comparative examples. The amount of cooling water was equal in the inventive examples in which the guide 140 illustrated in FIG. 10 is used and in the comparative examples in which the powder manufacturing apparatus illustrated in FIG. 2 is used.

Specifically, four jet nozzles 130 were used in Inventive Example 1, and eight jet nozzles 130 were used in Inventive Example 2. Two jet nozzles 30 were used in Comparative Example 1, and four jet nozzles 30 were used in Comparative Example 2.

As illustrated in FIG. 14, when the guide 140 was used in the inventive examples, the magnitude of impulse was relatively high even though the same number of nozzles was used. In particular, in the inventive examples, as long as a cooling fluid was ejected onto the guide 140, it was easy to apply a great impulse because the positions and types of nozzles had a little effect on the impulse application.

Figure 15:
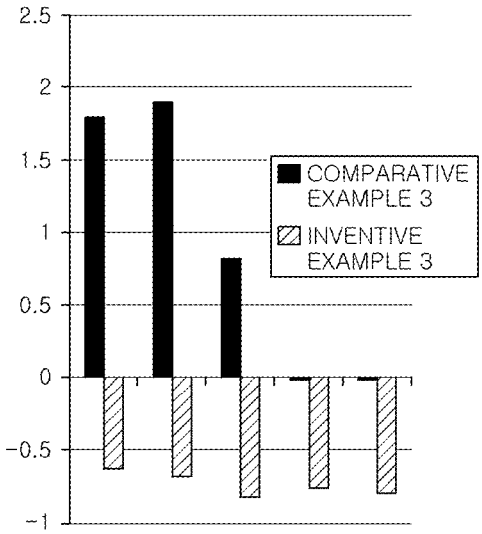
FIG. 15 is a graph illustrating vertical velocities measured near a molten steel striking point in inventive examples and comparative examples.

FIG. 15 is a graph illustrating vertical velocities measured near a striking point in inventive examples and comparative examples.

Referring to FIG. 15, guides such as the guide 140 illustrated in FIG. 8 were used in Inventive Example 3 and Comparative Example 3. However, the guide used in Inventive Example 3 included spirals 143 as illustrated in FIG. 10, and the guide used in Comparative Example 3 did not include spirals 143. That is, tests were performed in the same conditions except that the guide used in Comparative Example 3 did not have a structure inducing the formation of second streams 160. In FIG. 15, the x-axis refers to a height from a molten steel striking point, and the y-axis refers to velocity. In the y-axis, positive (+) values refer to upward velocities, and negative (−) values refer to downward velocities.

As illustrated in FIG. 15, In Comparative Example 3 in which second streams 160 were not formed, upward force was applied at a molten steel striking point, that is, an upward movement of molten steel was observed at the molten steel striking point. In Inventive Example 3 in which second streams 160 were formed, downward force was applied to a molten steel striking point owing to a descending air current, that is, molten steel was moved downward at the molten steel striking point.

Therefore, produced powder could be discharged downward and cooled in a state in which the particle size of the powder determined by impulse applied to the powder was maintained. Thus, the particle size distribution of the powder was concentrated on the average particle size of the powder. Thus, the amount of oversized powder could be reduced, and thus the yield of powder could be improved.

While exemplary embodiments have been shown and described above with reference to the accompanying drawings, it will be apparent to those skilled in the art that modifications and variations could be made without departing from the scope of the present invention.

The invention claimed is:

1. A powder manufacturing apparatus comprising:

a molten steel chamber supplying molten steel; and a cooling fluid ejector disposed below the molten steel chamber and ejecting water to the molten steel supplied from the molten steel chamber to atomize the molten steel, wherein the cooling fluid ejector comprises:

a guide comprising a truncated cone part pointed downward so that the molten steel flowing downward from the molten steel chamber passes through a center region of the truncated cone part to form a first stream to cool and atomize the molten steel and a second stream to create a descending air current for the molten steel; and a jet nozzle pointed toward an outer surface of the truncated cone part so that the water is ejected toward the outer surface of the truncated cone part, wherein the truncated cone part has a spiral on the outer surface of the truncated cone part to induce the second stream which swirls downward around the molten steel flowing downward, and wherein the spiral induces the descending air current at a point at which extension lines drawn from a slope of the truncated cone part intersect each other.

2. The powder manufacturing apparatus of claim 1, wherein the spiral is a groove in a surface of the guide.

3. The powder manufacturing apparatus of claim 1, wherein a plurality of spirals are symmetrically arranged on the guide.

4. The powder manufacturing apparatus of claim 1, wherein the cooling fluid ejector is configured so that the first stream flows at a rate greater than a rate at which the second stream flows.

5. The powder manufacturing apparatus of claim 1, wherein the jet nozzle is a straight jet nozzle.

6. The powder manufacturing apparatus of claim 5, wherein the jet nozzle is located above the truncated cone part of the guide, and an angle between the jet nozzle and a vertical line is greater than an angle between a slope of the truncated cone part and the vertical line.

* * * * *